US007904990B1

(12) United States Patent
Miner

(10) Patent No.: US 7,904,990 B1
(45) Date of Patent: Mar. 15, 2011

(54) EXTRACTION CLEANING WITH ALTERNATING FLUID DISTRIBUTION

(75) Inventor: Jonathan L. Miner, Rockford, MI (US)

(73) Assignee: BISSELL Homecare Inc., Grand Rapids, MI (US)

( * ) Notice: Subject to any disclaimer, the term of this patent is extended or adjusted under 35 U.S.C. 154(b) by 936 days.

(21) Appl. No.: 11/275,472

(22) Filed: Jan. 6, 2006

Related U.S. Application Data

(60) Provisional application No. 60/593,360, filed on Jan. 7, 2005.

(51) Int. Cl.
*A47L 7/00* (2006.01)

(52) U.S. Cl. ..... 15/320

(58) Field of Classification Search ..... 15/320, 15/322, 323, 353
See application file for complete search history.

(56) References Cited

U.S. PATENT DOCUMENTS

| | | | | |
|---|---|---|---|---|
| 4,014,067 | A | 3/1977 | Bates | |
| 4,167,799 | A | 9/1979 | Webb | |
| 4,295,243 | A | 10/1981 | King | |
| 5,237,720 | A | 8/1993 | Blase et al. | |
| 6,131,237 | A | 10/2000 | Kasper et al. | |
| 6,453,506 | B1 * | 9/2002 | Sumner | 15/322 |
| 6,681,442 | B2 | 1/2004 | Coates et al. | |
| 7,392,566 | B2 * | 7/2008 | Gordon et al. | 15/319 |
| 2002/0092115 | A1 * | 7/2002 | Zahuranec et al. | 15/320 |
| 2003/0159232 | A1 * | 8/2003 | Hekman et al. | 15/320 |
| 2005/0091782 | A1 * | 5/2005 | Gordon et al. | 15/320 |

* cited by examiner

*Primary Examiner* — David B Thomas
(74) *Attorney, Agent, or Firm* — McGarry Bair PC

(57) ABSTRACT

Surface cleaning wherein recovering a soiled cleaning fluid from a surface to be cleaned is subsequent to the application of fluid to the surface as a module moves along a given direction as a module moves along different and opposite directions. A method and apparatus are disclosed.

11 Claims, 5 Drawing Sheets

EXTRACTION CLEANING WITH ALTERNATING FLUID DISTRIBUTION

CROSS-REFERENCE TO RELATED APPLICATION

This application claims the benefit of U.S. provisional application Ser. No. 60/593,360, filed Jan. 7, 2005, which is incorporated herein in its entirety.

BACKGROUND OF THE INVENTION

1. Field of the Invention

This invention relates to extraction cleaning. In one of its aspects, the invention relates to extraction cleaning with enhanced cleaning performance. In another of its aspects, the invention relates to an extraction cleaning machine wherein the dwell time for cleaning fluid applied to a surface to be cleaned is constant regardless of the direction of movement of the cleaning machine. In another of its aspects, the invention relates to a method for cleaning a carpet or other floor surface wherein a cleaning module with a suction nozzle is moved forwardly and rearwardly along the surface to be cleaned and cleaning fluid is applied to the surface after suction is applied to the surface to equalize the dwell time of the cleaning fluid regardless of the direction of movement of the cleaning module along the surface to be cleaned.

2. Description of the Related Art

Extraction cleaning machines have been used for removing dirt from surfaces such as carpeting and hard surface floors. The extraction cleaning machines can be in the form of a canister-type unit, as disclosed in U.S. Pat. No. 5,237,720 to Blase et al., or an upright unit, as disclosed in U.S. Pat. No. 6,131,237 to Kasper et al.

Either type of unit contains a fluid delivery system for depositing a quantity of cleaning solution on the surface through a spray dispenser assembly. The cleaning solution dissolves the dirt, removes the dirt from the surface to be cleaned, and places the dirt in suspension, which aids in the vacuum removal of the dirt from the surface. After period of time, the cleaning solution is removed through a vacuum process. The longer the cleaning solution remains on the surface, the more effective the cleaning solution is in cleaning the surface.

Conventional extraction cleaning machines have a spray dispenser assembly which is typically adjacent to and to the rear of the suction nozzle. As the extraction cleaning machine is moved in a forward direction, the cleaning fluid will be deposited on the surface to be cleaned behind the suction nozzle, leaving a wetted surface behind it. When the extraction cleaning machine is moved rearwardly, the suction nozzle trails the spray dispenser and removes the cleaning fluid almost as soon as it is applied to the surface. Consequently, the cleaning solution has a different dwell time on the surface between the forward and rearward stroke of the machine. Further, the surface is scrubbed with a brush in the forward direction after the cleaning solution is deposited and is scrubbed with a brush before application of the cleaning solution on the rearward stroke. Accordingly, the cleaning fluid may not remain on the surface to be cleaned a sufficient time to most effectively clean the surface on the rearward stroke of the machine.

U.S. Pat. No. 4,014,067 to Bates discloses a carpet cleaner having a pair of spray dispensers on either side of a scrubbing brush and behind the suction nozzle.

U.S. Pat. No. 6,681,442 to Coates et al., issued Jan. 27, 2004, discloses an extractor having a spray dispenser for depositing different liquids to a surface wherein the liquid delivery is controlled by the direction of movement of the extractor.

SUMMARY OF THE INVENTION

A portable surface cleaning apparatus comprises a module for movement along a surface to be cleaned and including a cleaning fluid dispensing system for depositing cleaning fluid to a surface to be cleaned, a suction nozzle adjacent to the surface and a vacuum source fluidly connected to the suction nozzle for removing soiled cleaning fluid from the surface. The fluid dispensing system comprises a liquid dispenser on either side of the suction nozzle, a valve for controlling the supply of cleaning fluid to each of the liquid dispensers and a control system for switching the valve between the forward and rearward liquid dispensers when the module is moving in a rearward or forward direction, respectively so that the application of the cleaning fluid follows the movement of the suction nozzle along the surface to be cleaned.

Further according to the invention, a method for cleaning a surface comprises the steps of applying a first quantity cleaning fluid to the surface sequentially along a first direction and applying a second quantity of cleaning fluid sequentially along the surface in a second direction; entraining dirt and debris in the cleaning fluid; extracting the first quantity of cleaning fluid with the entrained dirt and debris from the surface along the second direction and extracting the second quantity of cleaning fluid along the first direction; and collecting the extracted cleaning fluid with the entrained dirt and debris.

In one embodiment of the invention, the extracting and the applying steps are carried out sequentially in both the first and second directions.

In another embodiment of the invention, the step of entraining the dirt and debris includes scrubbing the surface.

Still further according to the invention, a method for cleaning a surface comprises the steps of moving a cleaning module along the surface in a first direction and a second direction; applying a cleaning fluid sequentially to the surface as the module moves along the surface in the first and second directions; entraining dirt and debris in the cleaning fluid; and recovering the cleaning fluid applied to the surface during the movement of the module in the second direction and with the entrained dirt and debris as the module moves along the surface in the first direction and recovering the cleaning fluid applied to the surface during the movement of the module in the first direction and with the entrained dirt and debris from the surface as the module moves along the surface in the second direction.

In one embodiment of the invention, the second direction is opposite to the first direction.

In another embodiment of the invention, the step of entraining the dirt and debris includes scrubbing the surface.

DESCRIPTION OF AN EMBODIMENT OF THE INVENTION

Figure 1:
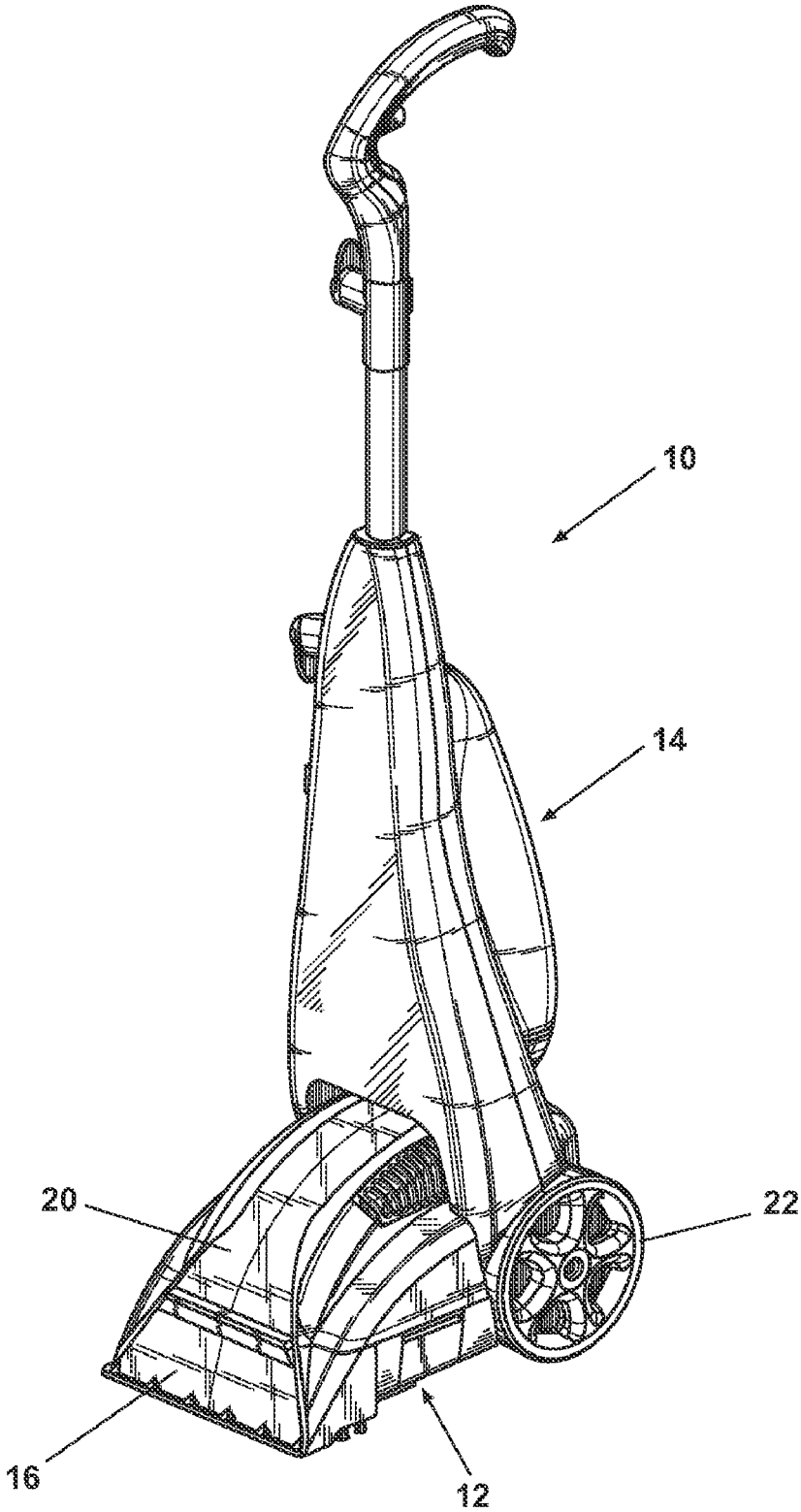
FIG. 1 is a perspective view of an upright extraction cleaning machine according to the invention.
Figure 2:
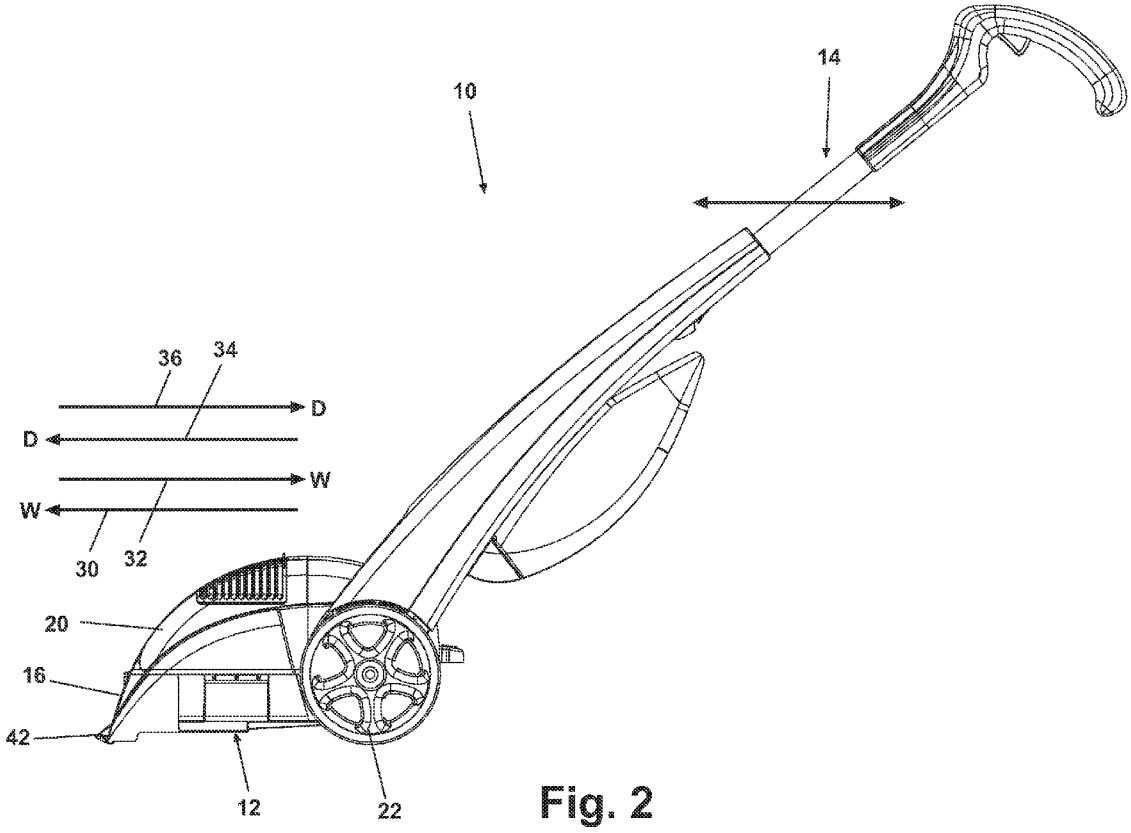
FIG. 2 is a side elevation view of the upright extraction cleaning machine illustrated in FIG. 1 showing movement of the upright extraction cleaning machine during wetting and drying of a surface to be cleaned.

Referring now to the drawings and to FIGS. 1 and 2 in particular, an embodiment of the invention is illustrated comprising a portable extraction cleaning machine 10 having a base module 12 with wheels 22 to support the module 12 for movement along a surface to be cleaned, and an upright handle assembly 14 pivotally mounted to a rear portion of the base module 12 for manipulating the base module 12 for cleaning the surface. The invention is described and illustrated herein with respect to an embodiment comprising an upright extraction cleaning machine, although the invention can also be utilized in a canister-type cleaning machine. The upright extraction cleaning machine 10 is a generally well-known device comprising several of the features and operations described in U.S. Pat. No. 6,131,237 to Kasper et al., which is incorporated herein by reference in its entirety. Such well-known features and operations will not be described in detail herein, except as otherwise necessary for a complete understanding of the invention.

As illustrated in FIG. 2, the extraction cleaning machine 10 is intended to be moved in alternating forward and rearward directions during the cleaning process, as illustrated by the two headed arrow. The typical cleaning process involves a first wetting pass 30 in a forward direction wherein cleaning solution is applied to the surface to be cleaned, followed by a second wetting pass 32 in a rearward direction wherein cleaning solution is again applied to the surface. This movement is followed by a first drying pass 34 in a forward direction wherein the cleaning solution is vacuumed from the surface, and finally a second drying pass 36 in a rearward direction wherein additional vacuuming is performed.

The base module 12 includes a housing 20 having a front portion 16. The housing 20 forms an enclosure for a motor 24 operating a well-known liquid vacuum system (not shown), an agitation assembly 26, a liquid delivery system comprising a plurality of outlet dispensers 40, 42 for applying liquid to the carpet, liquid reservoirs, and the like.

Figure 3:
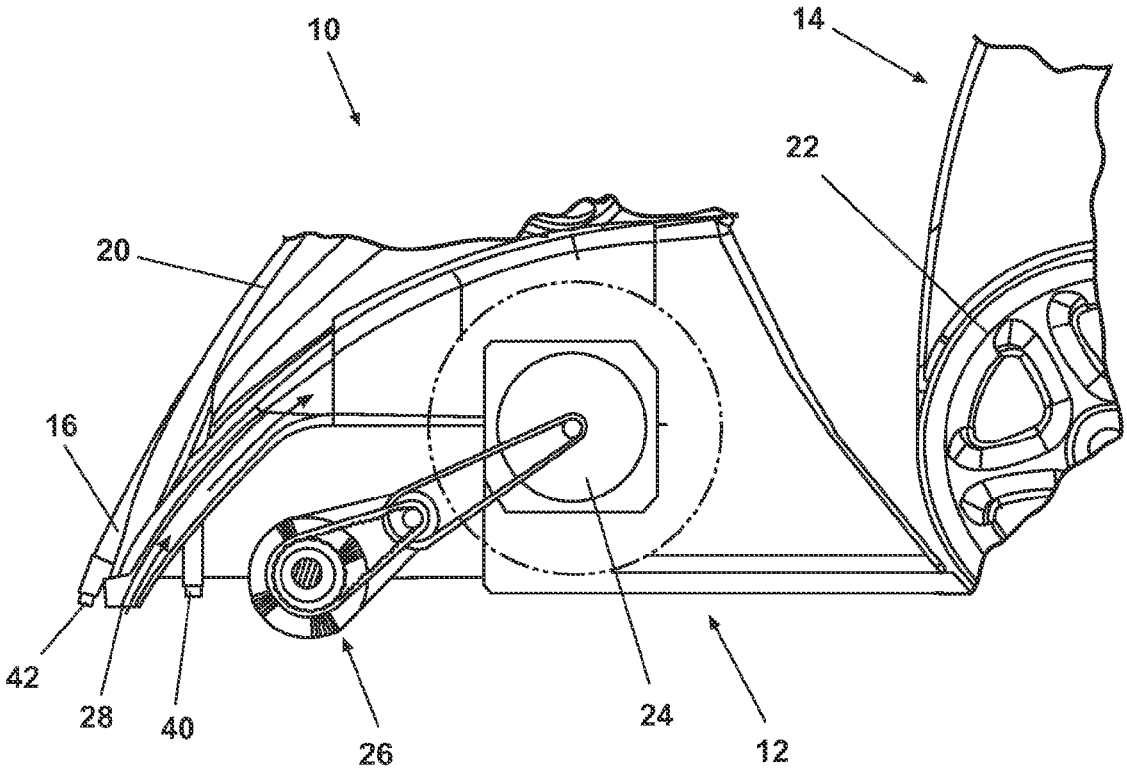
FIG. 3 is a partial sectional side view of the extraction cleaning machine of FIG. 1 illustrating the location of a pair of cleaning fluid spray dispenser assemblies for alternately delivering cleaning fluid to a surface to be cleaned.

As illustrated in FIG. 3, the vacuum system comprises a suction nozzle 28 at the front portion 16 of the housing 20 adapted for vacuum removal of liquid from the surface to be cleaned. Immediately rearward of the suction nozzle 28 is a first assembly of outlet dispensers 40 for spraying cleaning solution onto the surface. The number of outlet dispensers 40 can be selected based upon, for example, the pattern of liquid delivery from each dispenser, the width of the cleaning machine 10, and the desired coverage of the spray pattern from each dispenser 40. The dispensers 40 are fluidly connected in a well-known manner to the fluid delivery system of the extraction cleaning machine 10.

Immediately forward of the suction nozzle 28 is a second assembly of outlet dispensers 42 for spraying cleaning solution onto the surface to be cleaned. The number of outlet dispensers 42 can be selected upon, for example, the pattern of liquid delivery from each dispenser, the width of the cleaning machine 10, and the desired coverage of the spray pattern from each dispenser 42. The dispensers 42 are fluidly connected in a well-known manner to the fluid delivery system of the extraction cleaning machine 10. The dispensers 40, 42 are positioned relative to the suction nozzle 28 so that when the base module 12 is moved in a forward direction, fluid from the first dispenser assembly 40 remains on the surface to be cleaned until the suction nozzle 28 passes over the wetted area during a rearward pass of the base module 12. Similarly, fluid from the second dispenser assembly 42 when the base module 12 is moved in a rearward direction will remain on the surface until the suction nozzle 28 passes over the wetted area during a forward pass of the base module 12.

Figure 4:
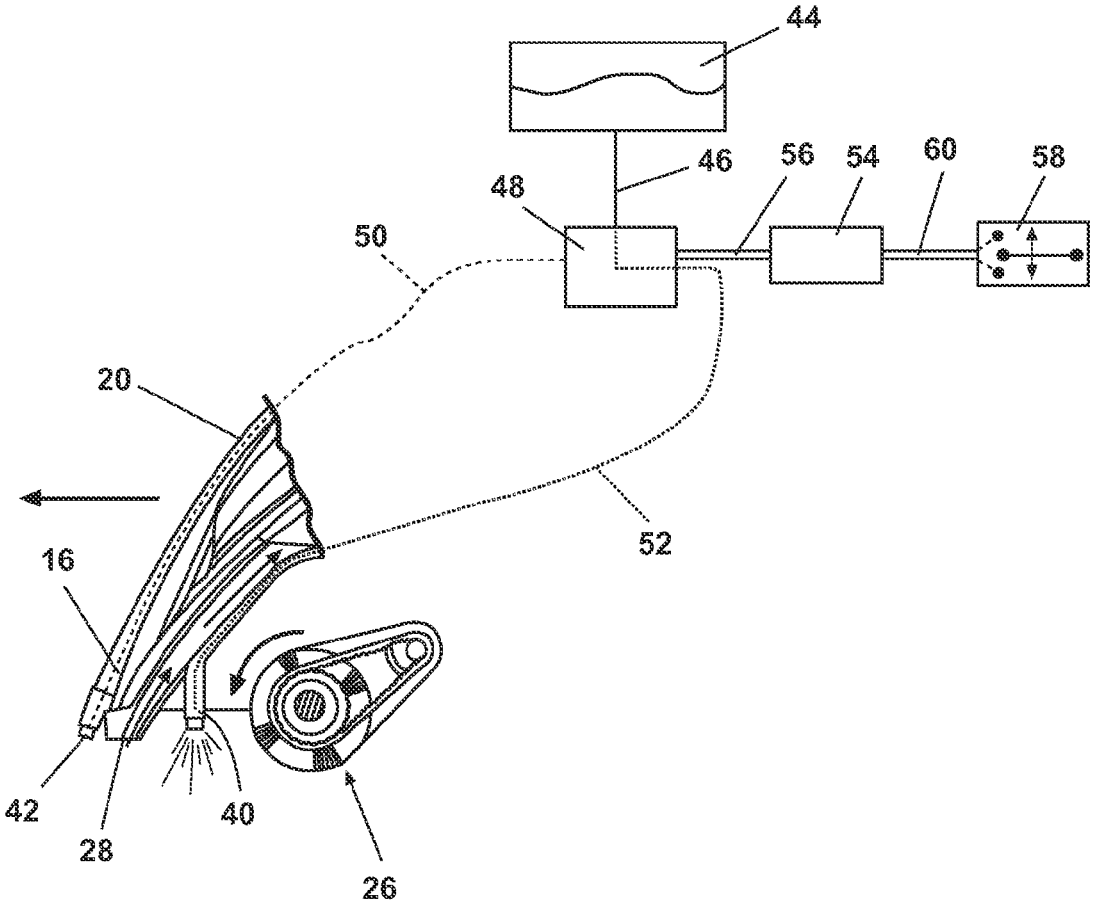
FIG. 4 is a schematic representation of the delivery of cleaning fluid from a first cleaning fluid spray dispenser assembly during forward movement of the extraction cleaning machine of FIG. 1.
Figure 5:
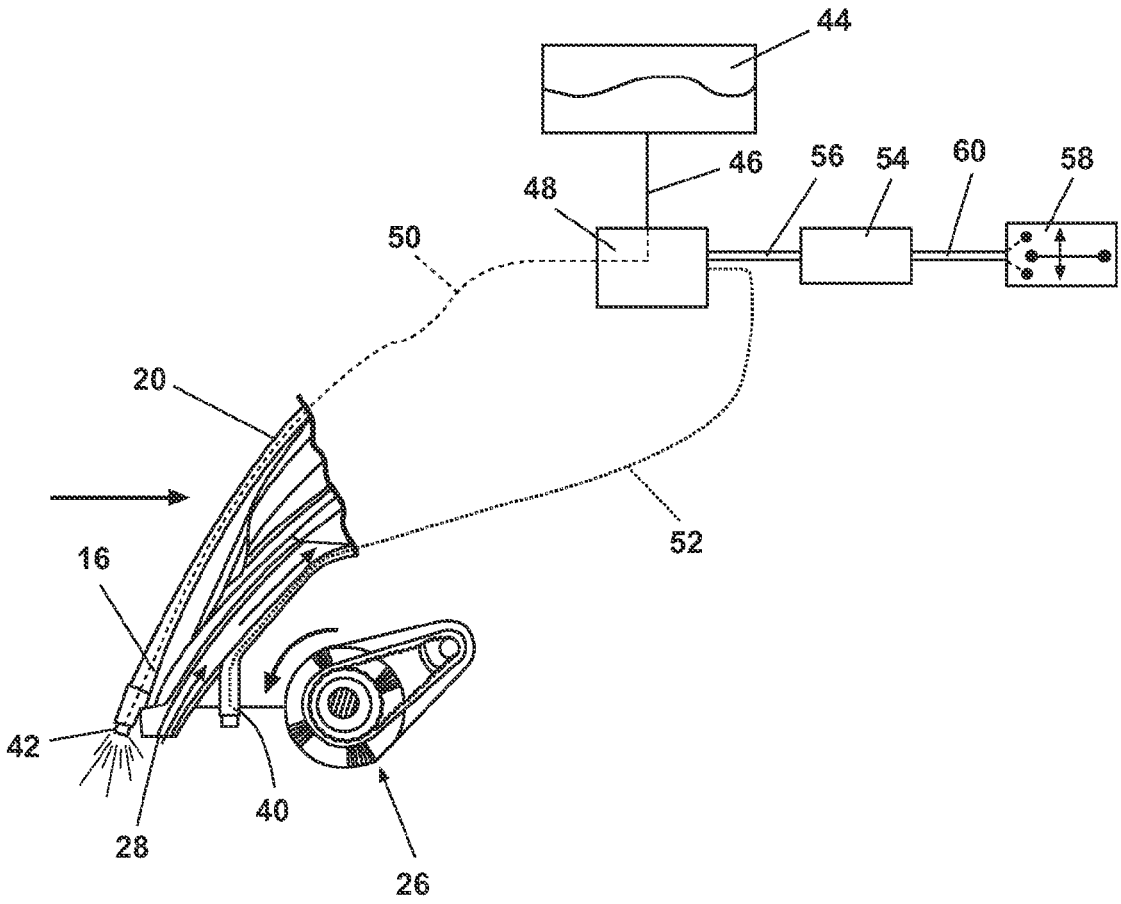
FIG. 5 is a schematic representation of the delivery of cleaning fluid from a second cleaning fluid spray dispenser assembly during rearward movement of the extraction cleaning machine of FIG. 1.

FIGS. 4 and 5 illustrate an embodiment of a dispenser control system for controlling the selective delivery of cleaning fluid to the dispensers 40, 42. It is anticipated that other configurations of a suitable control system would be evident to a person of ordinary skill in the relevant art, and other configurations are possible without departing from the spirit of the invention. The dispensers 40, 42 are fluidly connected to a well-known cleaning fluid reservoir 44. The cleaning fluid reservoir 44 is fluidly connected through a cleaning fluid supply line 46 to a valve 48. The valve 48 can selectively deliver cleaning fluid to the rear outlet dispenser assembly 40 through a rear dispenser supply line 52 or to the forward outlet dispenser assembly 42 through a forward dispenser supply line 50.

The valve 48 is operably connected to a suitable control device 54 through a control connection 56. The control device 54 is capable of operating the valve 48 in response to an input signal corresponding to the selection of the nozzle assembly 40, 42 through which cleaning fluid is to be delivered. The control device 54 is operably connected through a switch connection 60 to a switch 58 which is used to select the dispenser assembly 40, 42 through which cleaning fluid is to be delivered. The switch 58 can comprise a well-known hand-operated toggle switch which can toggle between a first actuating position, a second actuating position, and an off position. The switch 58 can also comprise a mechanism tied to the movement of the base module 12, such as a magnet-based sensor to generate an actuation signal indicating the direction of rotation of the wheels 22 such as a magnet attached to the wheels that moves past a sensor during rotation of the wheels. Similarly, a switch similar to that described in U.S. Pat. No. 6,681,442 to Coates et al. can automatically generate a first control signal when the handle assembly 14 is telescopically moved in a first direction corresponding to forward movement of the base module 12, and a second control signal when the handle assembly 14 is telescopically moved in a second direction corresponding to rearward movement of the base module 12.

As illustrated in FIG. 4, movement of the base module 12 in a forward direction is accompanied by delivery of cleaning fluid from the reservoir 44 to the rear outlet dispenser assembly 40. The cleaning fluid can then be scrubbed into the carpet by the agitation assembly 26. The base module 12 can then be moved in a rearward direction as illustrated in FIG. 5, accompanied by delivery of cleaning fluid from the reservoir 44 to the forward outlet dispenser assembly 42. The previously deposited cleaning fluid from the rear outlet dispenser assembly 40 will be removed from the surface to be cleaned by the vacuum applied through the suction nozzle 28. The cleaning fluid deposited from the forward outlet dispenser assembly 42 will remain on the surface to further loosen and suspend dirt for subsequent removal through the suction nozzle 28 upon a subsequent pass of the base module 12.

The use of dual alternating dispenser assemblies for delivery of cleaning solution to the surface being cleaned can facilitate the cleaning of the surface by leaving cleaning solution on the surface for a longer period of time than with a conventional single fluid dispensing mechanism. Cleaning fluid can be discharged through the rear spray dispensers onto the surface to be cleaned during forward travel of the extraction cleaning machine, to be scrubbed by the agitation assembly. Rearward travel of the extraction cleaning machine will result in the cleaning fluid deposited during the forward pass being extracted through the suction nozzle in a well-known manner. However, additional cleaning fluid will be deposited through the forward spray dispensers during the rearward travel of the extraction cleaning machine, thereby increasing the period of time during which cleaning fluid is applied to the surface being cleaned. This additional time enables the cleaning fluid to more effectively clean the surface.

The use of an automatic dispensing selection switching device can deliver the cleaning solution to the selected dispensing assembly without the necessity of operator input. The use of the switching device will ensure that the cleaning fluid is properly applied to the surface to be cleaned.

With a canister-type cleaning machine having a canister base module and a wand, the liquid vacuum system, the cleaning fluid reservoir 44, the control device 54, and the valve 48 can be housed in the canister. The suction nozzle 28 and the outlet dispensers 40, 42 can be housed in the wand head in a configuration similar to that described and illustrated for the upright extraction cleaning machine 10. The switch 58 can be placed at a suitable position on the wand. Supply lines extending from the wand head to the canister fluidly interconnect the outlet dispensers 40, 42 with the cleaning fluid reservoir 44, the control device 54, and the valve 48.

The switch 58 would be tied to the movement of the wand, rather than the base module. A magnet-based sensor could be tied to the direction of rotation of wheels in the head, such as a magnet attached to the wheel that moves past a sensor during rotation of the wheel. Alternatively, a switch similar to that described in U.S. Pat. No. 6,681,442 to Coates et al. could generate signals corresponding to telescopic movement of the wand in a forward or rearward direction.

While the invention has been specifically described in connection with certain specific embodiments thereof, it is to be understood that this is by way of illustration and not of limitation. For example, the invention has been described with respect to the delivery of cleaning fluid to a floor surface through spray dispensers wherein the cleaning fluid is typically pressurized by a pump. It is within the scope of the invention to deliver the cleaning fluid to the surface to be cleaned by other means, such as a gravity-fed system with distribution bars instead of spray nozzles and a pump.

Reasonable variation and modification are possible within the scope of the forgoing disclosure and drawings without departing from the spirit of the invention which is defined in the appended claims.

What is claimed is:

1. A portable surface cleaning apparatus, comprising:

a base module for movement along a surface to be cleaned, the base module including:

a cleaning fluid dispensing system for applying a cleaning fluid to the surface;

a suction nozzle associated with the module for removing soiled cleaning fluid from the surface; and one of a cleaning fluid reservoir and a vacuum source;

wherein the cleaning fluid dispensing system includes a first fluid distribution system forward of the suction nozzle and a second fluid distribution system rearward of the suction nozzle; and wherein the vacuum source is fluidly connected to the suction nozzle for removing soiled cleaning fluid from the surface through the suction nozzle; and a control system for selectively controlling the flow of cleaning fluid to the first and second fluid distribution systems and the removal of cleaning fluid through the suction nozzle so that cleaning fluid is deposited on the surface to be cleaned through the second fluid distribution system during forward movement of the base module and is removed through the suction nozzle during rearward movement of the base module, and cleaning fluid is deposited on the surface to be cleaned through the first fluid distribution system during rearward movement of the base module and is removed through the suction nozzle during forward movement of the base module.

2. A method for cleaning a surface comprises the steps of:

applying a first quantity of cleaning fluid to the surface sequentially along a first direction and applying a second quantity of cleaning fluid sequentially along the surface in a second direction;

entraining dirt and debris in the cleaning fluid;

extracting the first quantity of cleaning fluid with the entrained dirt and debris from the surface along the second direction and extracting the second quantity of cleaning fluid with the entrained dirt and debris from the surface along the first direction; and collecting the extracted cleaning fluid with the entrained dirt and debris into a fluid recovery chamber housed within a cleaning module moveable along the surface.

3. A method for cleaning a surface according to claim 2 wherein the extracting and the applying steps are carried out sequentially in both the first and second directions.

4. A method for cleaning a surface according to claim 2 wherein the step of entraining the dirt and debris includes scrubbing the surface.

5. A method for cleaning a surface comprises the steps of:

moving a cleaning module along the surface in a first direction and a second direction;

applying a cleaning fluid sequentially to the surface as the module moves along the surface in the first and second directions;

entraining dirt and debris in the cleaning fluid;

recovering into a fluid recovery chamber housed within the module the cleaning fluid applied to the surface during the movement of the module in the second direction with the entrained dirt and debris from the surface as the module moves along the surface in the first direction, and recovering into the fluid recovery chamber housed within the module the cleaning fluid applied to the surface during the movement of the module in the first direction with the entrained dirt and debris from the surface as the module moves along the surface in the second direction.

6. A method for cleaning a surface according to claim 5 wherein the second direction is opposite to the first direction.

7. A method for cleaning a surface according to claim 5 wherein the step of entraining the dirt and debris includes scrubbing the surface.

8. A portable surface cleaning apparatus, comprising:

a base module for movement along a surface to be cleaned and including:

a cleaning fluid dispensing system for applying a cleaning fluid to the surface;

a suction nozzle associated with the module for removing soiled cleaning fluid from the surface; and a vacuum source fluidly connected to the suction nozzle for removing soiled cleaning fluid from the surface through the suction nozzle; and wherein the cleaning fluid dispensing system includes a first fluid distribution system forward of the suction nozzle and a second fluid distribution system rearward of the suction nozzle; and a control system, including a switching device comprising one of a toggle switch and a magnetic field sensor for selecting a delivery of cleaning fluid through one of the first and second fluid distribution systems, the control system selectively controlling the flow of cleaning fluid to the first and second fluid distribution systems and the removal of cleaning fluid through the suction nozzle;

wherein cleaning fluid is deposited on the surface to be cleaned through the second fluid distribution system during forward movement of the base module, and is removed through the suction nozzle during rearward movement of the base module; and wherein cleaning fluid is deposited on the surface to be cleaned through the first fluid distribution system during rearward movement of the base module and is removed through the suction nozzle during forward movement of the base module.

9. The portable surface cleaning apparatus of claim 8 wherein the module includes a wand.

10. A portable surface cleaning apparatus, comprising:

a base module for movement along a surface to be cleaned and including:

a suction nozzle, fluidly coupled with a vacuum source associated with the module, for removing soiled cleaning fluid from the surface through the suction nozzle; and a cleaning fluid dispensing system, including a cleaning fluid reservoir, for applying cleaning fluid to the surface, including a first fluid distribution system forward of the suction nozzle and a second fluid distribution system rearward of the suction nozzle, the first fluid distribution system and the second fluid distribution system fluidly coupled with the cleaning fluid reservoir by a 3-way valve; and a control system for selectively controlling the 3-way valve to control the flow of cleaning fluid to the first and second fluid distribution systems, and to control the removal of cleaning fluid through the suction nozzle;

wherein cleaning fluid is deposited on the surface to be cleaned through the second fluid distribution system during forward movement of the base module and is removed through the suction nozzle during rearward movement of the base module; and wherein cleaning fluid is deposited on the surface to be cleaned through the first fluid distribution system during rearward movement of the base module and is removed through the suction nozzle during forward movement of the base module.

11. The portable cleaning apparatus of claim 10 wherein the control system comprises a switching device wherein delivery of cleaning fluid through one of the first and second fluid distribution systems is selected by operation of the switching device.

* * * * *